US007979013B2

(12) United States Patent
Yoshida et al.

(10) Patent No.: US 7,979,013 B2
(45) Date of Patent: Jul. 12, 2011

(54) DEVELOPING DEVICE OF IMAGE FORMING APPARATUS

(75) Inventors: Tomofumi Yoshida, Tokyo (JP); Hirobumi Ooyoshi, Tokyo (JP); Kenzo Tatsumi, Osaka (JP); Yoshihiro Kawakami, Hyogo (JP); Yoshiyuki Shimizu, Osaka (JP); Tomohiro Kubota, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 721 days.

(21) Appl. No.: 11/951,584

(22) Filed: Dec. 6, 2007

(65) Prior Publication Data

US 2008/0145108 A1 Jun. 19, 2008

(30) Foreign Application Priority Data

Dec. 18, 2006 (JP) ..... 2006-339782

(51) Int. Cl.
*G03G 15/08* (2006.01)

(52) U.S. Cl. ..... 399/281

(58) Field of Classification Search ..... 399/281
See application file for complete search history.

(56) References Cited

U.S. PATENT DOCUMENTS

| | | | |
|---|---|---|---|
| 5,532,795 | A | 7/1996 | Tatsumi et al. |
| 5,557,382 | A | 9/1996 | Tatsumi et al. |
| 5,678,125 | A | 10/1997 | Kutsuwada et al. |
| 5,734,953 | A | 3/1998 | Tatsumi |
| 5,765,079 | A | 6/1998 | Yoshiki et al. |
| 5,815,767 | A | 9/1998 | Kutsuwada et al. |
| 5,828,935 | A | 10/1998 | Tatsumi et al. |
| 5,887,224 | A | 3/1999 | Mizuishi et al. |
| 5,915,143 | A | 6/1999 | Watanabe et al. |
| 6,006,050 | A | 12/1999 | Watanabe et al. |
| 6,055,388 | A | 4/2000 | Watanabe et al. |
| 6,085,062 | A | 7/2000 | Mizuishi et al. |
| 6,128,449 | A | 10/2000 | Zenba et al. |
| 6,144,811 | A | 11/2000 | Ohori et al. |

(Continued)

FOREIGN PATENT DOCUMENTS

JP 2001-194883 7/2001

OTHER PUBLICATIONS

U.S. Appl. No. 12/170,842, filed Jul. 10, 2008, Kubota, et al.

(Continued)

*Primary Examiner* — David M Gray
*Assistant Examiner* — Andrew V Do
(74) *Attorney, Agent, or Firm* — Oblon, Spivak, McClelland, Maier & Neustadt, L.L.P.

(57) ABSTRACT

A developing device that can be formed at low cost and without increasing the complexity of a die structure of a casing comprises a development roller, a supply roller, a developing portion having an agitating member, a toner hopper disposed above the developing portion, an agitating member in the toner hopper, a partitioning member provided between the developing portion and the toner hopper and having an opening portion, and a collected developer storage portion forming portion for forming a storage space for collected toner collected from the development roller by the supply roller within a fixed distance of the supply roller such that the collected toner moves to the vicinity of the agitating member in the developing portion in accordance with a developer flow generated by the rotation of the supply roller. A pre-incorporation component formed by integrating the partitioning member, the collected developer storage portion forming portion, and a bearing portion for supporting the agitating members is incorporated into the casing.

15 Claims, 5 Drawing Sheets

U.S. PATENT DOCUMENTS

| | | | | |
|---|---|---|---|---|
| 6,144,822 | A | 11/2000 | Yamaguchi et al. | |
| 6,148,161 | A | 11/2000 | Usui et al. | |
| 6,160,969 | A | 12/2000 | Ishigaki et al. | |
| 6,266,501 | B1 | 7/2001 | Mizuishi et al. | |
| 6,628,903 | B1 | 9/2003 | Ohori et al. | |
| 6,665,511 | B2 | 12/2003 | Takeuchi et al. | |
| 6,731,893 | B2 * | 5/2004 | Okoshi | 399/119 |
| 6,771,918 | B2 | 8/2004 | Tatsumi | |
| 6,898,383 | B2 | 5/2005 | Ohori et al. | |
| 7,027,761 | B2 | 4/2006 | Koetsuka et al. | |
| 7,110,710 | B2 | 9/2006 | Yamashita et al. | |
| 7,184,691 | B2 | 2/2007 | Kita et al. | |
| 7,214,461 | B2 | 5/2007 | Yamashita et al. | |
| 2003/0219669 | A1 | 11/2003 | Yamashita et al. | |
| 2006/0216062 | A1 * | 9/2006 | Kawai | 399/111 |
| 2006/0268373 | A1 | 11/2006 | Tatsumi et al. | |
| 2007/0104523 | A1 | 5/2007 | Yoshida et al. | |
| 2007/0140747 | A1 | 6/2007 | Kita et al. | |
| 2007/0140763 | A1 | 6/2007 | Shimizu et al. | |
| 2007/0212119 | A1 | 9/2007 | Kurenuma et al. | |
| 2007/0248390 | A1 | 10/2007 | Kubota et al. | |

OTHER PUBLICATIONS

U.S. Appl. No. 11/768,607, filed Jun. 26, 2007, Yoshihiro Kawakami, et al.

* cited by examiner

DEVELOPING DEVICE OF IMAGE FORMING APPARATUS

BACKGROUND OF THE INVENTION

1. Field of the Invention

The present invention relates to a developing device used in an image forming apparatus such as a copier, a facsimile, or a printer.

2. Description of the Related Art

A so-called vertical developing device, in which a large space housing replenishment developer and serving as a developer accommodating portion is disposed above a developing portion comprising a development roller, is disclosed in Japanese Unexamined Patent Application Publication 2001-194883, for example, as a developing device used in this type of image forming apparatus. In this developing device, the replenishment developer is supplied in an appropriate amount by falling naturally into the developing portion from a developer accommodating chamber through an opening portion provided in a partitioning member for partitioning the developer accommodating chamber and the developing portion. A rotatable agitating member for agitating the developer is provided in the developer accommodating portion above the partitioning member, and therefore developer replenishment through natural falling is performed smoothly. Further, a rotatable agitating member for mixing together the supplied developer and the developer in the developing portion is provided in the developing portion below the partitioning member.

In the developing device constituted in this manner, the partitioning member is provided close to the agitating member in the developing portion, and therefore the agitating force of the agitating member extends to the developer in the vicinity of the partitioning member, leading to an improvement in the developer agitation performance. Further, the partitioning member functions to receive the weight of the developer in the developer accommodating portion, and therefore a situation in which the powder pressure of the developer increases in the developing portion due to the weight of the developer housed in the large developer accommodating portion such that an excessive amount of developer is charged, thereby adversely affecting the image, can be avoided.

Further, in the developing portion, a supply roller supplies the developer by contacting the development roller while rotating, and at the same time collects surplus developer from the development roller. It is preferable that the collected developer does not accumulate in the vicinity of the supply roller, but instead is moved to the vicinity of the agitating member in accordance with a developer flow generated by the rotation of the supply roller, mixed together with the replenishment developer supplied by the agitating member, and then re-supplied to the development roller via the supply roller. To create this movement in the developer, it is effective to provide a collected developer storage portion forming member for forming a collected developer storage space within a fixed distance of the supply roller such that the conveyance force of the supply roller extends to all of the collected developer.

Hence, the partitioning member for partitioning the developing portion and the developer accommodating portion and the collected developer storage portion forming member for forming a storage space for the collected developer are provided in the interior of the developing device. Generally, these members are either formed integrally with a casing for housing and holding the development roller, supply roller and so on, or incorporated into the casing as separate components.

The casing is a precision component requiring a function for holding components that have a direct effect on the image quality, such as the development roller, the supply roller and a development blade, with a high degree of precision, and is typically manufactured through die injection molding. When an attempt is made to form the partitioning member, the collected developer storage portion forming member, and a bearing portion of the agitating member integrally with the casing, the structure of the die becomes complicated. When the structure of the die becomes complicated, the heat balance deteriorates, leading to deterioration in the precision with which the components that require precision are held, and as a result, the image quality is adversely affected. Furthermore, when the structure of the die becomes complicated, productivity deteriorates and costs increase. Similarly, when a method of incorporating the members into the casing as separate components is employed, productivity deteriorates and costs increase.

SUMMARY OF THE INVENTION

The present invention has been designed in consideration of the background described above, and it is an object thereof to provide a developing device that can be formed at low cost and without increasing the complexity of a die structure for a casing.

In an aspect of the present invention, a developing device comprises a developer carrier for carrying a developer and conveying said developer to an opposing portion opposing a latent image carrier; a developing portion having a developer supply/collection member for supplying the developer while rotating in contact with the developer carrier and collecting the developer from the developer carrier; a developer accommodating portion provided above the developing portion and accommodating developer to be supplied to the developing portion; a partitioning member provided between the developing portion and the developer accommodating portion and having an opening portion; an accommodating portion developer agitating member disposed above the partitioning member for agitating the developer in the developer accommodating portion; a developing portion developer agitating member disposed below the partitioning member for agitating the developer in the developing portion; a collected developer storage portion forming portion for forming a storage space for the developer collected from the developer carrier by the developer supply/collection member within a fixed distance of the developer supply/collection member such that the collected developer moves to the vicinity of the developing portion developer agitating member in accordance with a developer flow generated by the rotation of the developer supply/collection member; and a casing for accommodating and holding all of the above. A pre-incorporation component formed by integrating the partitioning member, a bearing portion for supporting a side of the developing portion developer agitating member or the accommodating portion developer agitating member that does not receive a drive force, and the collected developer storage portion forming portion is incorporated into the casing.

In another aspect of the present invention, a developing device comprises a developer carrier for carrying a developer and conveying the the developer to an opposing portion opposing a latent image carrier; a developing portion having a developer supply/collection member for supplying the developer while rotating in contact with the developer carrier and collecting the developer from the developer carrier; a developer accommodating portion provided above the developing portion and accommodating developer to be supplied to the developing portion; a partitioning member provided between the developing portion and the developer accommodating portion and having an opening portion; an accommodating portion developer agitating member disposed above the partitioning member for agitating the developer in the developer accommodating portion; a developing portion developer agitating member disposed below the partitioning member for agitating the developer in the developing portion; a collected developer storage portion forming portion for forming a storage space for the developer collected from the developer carrier by the developer supply/collection member with in a fixed distance of the developer supply/collection member such that the collected developer moves to the vicinity of the developing portion developer agitating member in accordance with a developer flow generated by the rotation of the developer supply/collection member; and a casing for accommodating and holding all of the above. A pre-incorporation component formed by integrating the partitioning member and the collected developer storage portion forming portion is incorporated into the casing.

In another aspect of the present invention, a developing device comprises a developer carrier for carrying a developer and conveying the developer to an opposing portion opposing a latent image carrier; a developing portion having a developer supply/collection member for supplying the developer while rotating in contact with the developer carrier and collecting the developer from the developer carrier; a developer accommodating portion provided above the developing portion and accommodating developer to be supplied to the developing portion; a partitioning member provided between the developing portion and the developer accommodating portion and having an opening portion; an accommodating portion developer agitating member disposed above the partitioning member for agitating the developer in the developer accommodating portion; a developing portion developer agitating member disposed below the partitioning member for agitating the developer in the developing portion; and a casing for accommodating and holding all of the above. A pre-incorporation component formed by integrating the partitioning member and a bearing portion for supporting a side of the developing portion developer agitating member or the accommodating portion developer agitating member that does not receive a drive force is incorporated into the casing.

BRIEF DESCRIPTION OF THE DRAWINGS

The above and other objects, features and advantages of the present invention will become more apparent from the following detailed description taken with the accompanying drawings, in which.

DESCRIPTION OF THE PREFERRED EMBODIMENT

An embodiment of the present invention applied to a developing device employed in a color image forming apparatus will be described below.

Figure 1:
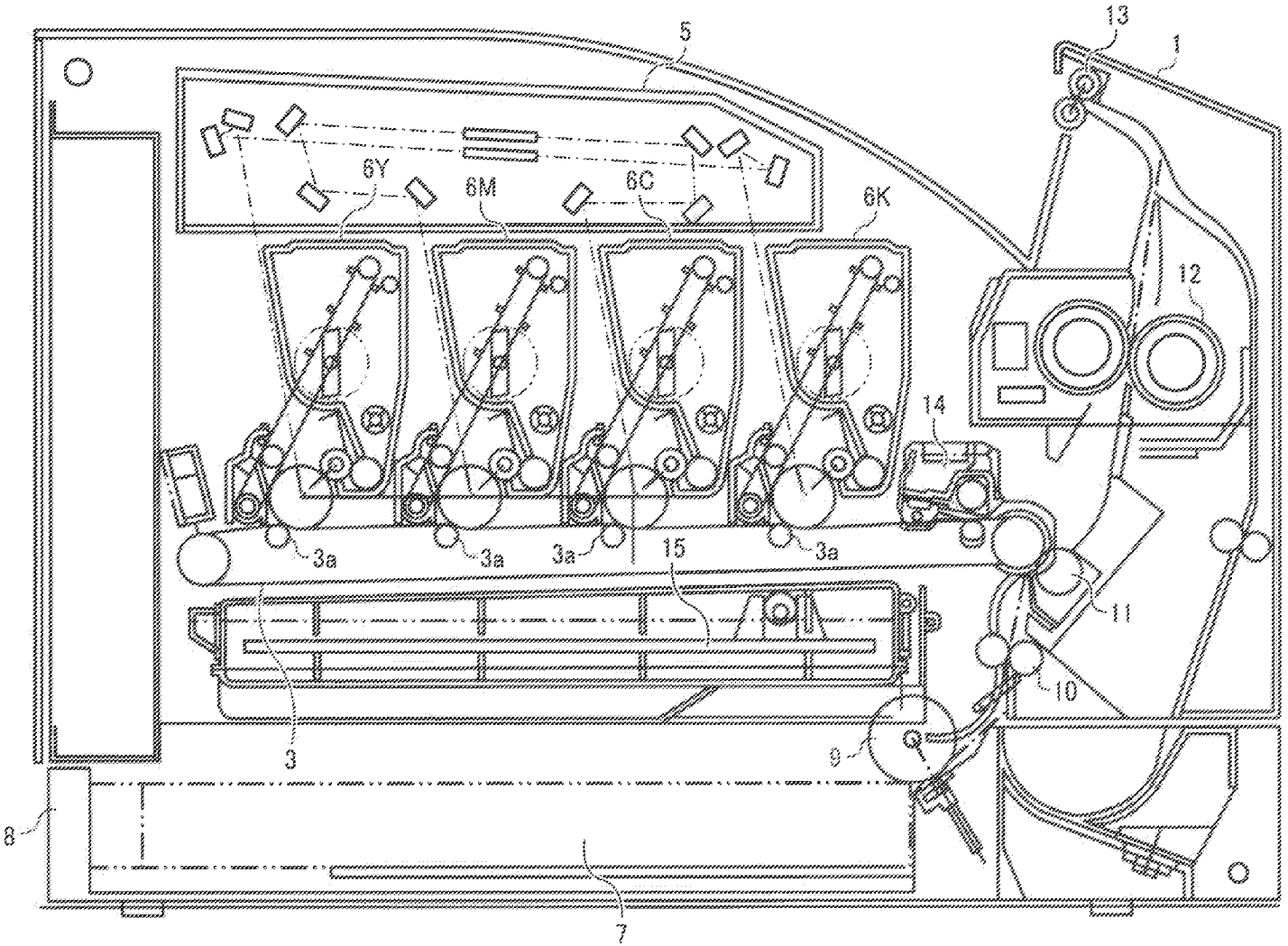
FIG. 1 is a view showing the schematic constitution of a color image forming apparatus employing a developing device according to an embodiment of the present invention.

FIG. 1 shows the schematic constitution of a color image forming apparatus employing the developing device according to this embodiment. This color image forming apparatus is a tandem-type indirect transfer image forming apparatus in which image creating units 6 (6Y, 6M, 6C, 6K) are arranged in series in a substantially central portion of an apparatus frame body. Each image creating unit 6 (6Y, 6M, 6C, 6K) comprises a drum-shaped photosensitive body for carrying a toner image. Here, Y, M, C and K are suffixes representing the colors yellow, magenta, cyan and black, respectively. An exposure device 5 for forming a latent image on the photosensitive body is disposed on an upper side of the image creating units 6. Toner image forming means such as a charging device, a developing device, a cleaning device and a neutralizing device for forming toner images in the respective colors are disposed on the periphery of the photosensitive body and supported integrally with the photosensitive body to form a process cartridge that can be attached to and detached from the image forming apparatus main body.

A transfer belt 3 serving as an intermediate transfer body is disposed on a lower side of the image creating units 6. A second transfer device 11 and an intermediate transfer body cleaning device 14 are disposed on the periphery of the transfer belt 3. Further, a first transfer roller 3*a* is disposed in a position where the image creating unit 6 contacts the transfer belt 3, and by applying a high potential to the first transfer roller 3*a*, a potential difference is generated between the photosensitive body and the transfer belt 3 such that the toner image formed on the photosensitive body is transferred onto the transfer belt 3.

A sheet feeding cassette 8 for carrying/housing a recording medium 7 is disposed on a lower side of the transfer belt 3. The recording medium 7, which is fed by a supply device 9, passes between the transfer belt 3 and the second transfer device 11, and is then led to a fixer 12 where the toner image is heat-fixed onto the recording medium 7.

The toner images of each color formed on the respective image creating units 6 are transferred onto the transfer belt 3 in sequence, and as a result, a multicolor toner image constituted by superposed monochrome toner images is formed on the transfer belt 3. The recording medium 7, such as a sheet of paper or an OHP sheet, is supplied to an opposing portion opposing the second transfer device 11 from the sheet feeding device 9 and a sheet conveying device 10 at a predetermined timing. A high potential is then applied to the monochrome or color toner image formed on the surface of the transfer belt 3 by the second transfer device 11 such that a potential difference is generated between the transfer belt 3 and the second transfer device 11, and as a result, the toner image formed on the surface of the transfer belt 3 is transferred onto the recording medium 7. Following transfer of the toner image, the recording medium 7 is peeled away from the transfer belt 3, whereupon the toner image is fixed onto the recording medium 7 by the fixer 12. The recording medium 7 is then discharged onto a discharge tray on the upper surface of the color electrophotographic apparatus 1 by a discharge device 13. Surplus toner remaining on the surface of the transfer belt 3 following transfer of the toner image onto the recording medium 7 is cleaned by the intermediate transfer body cleaning device 14 and collected in a toner collecting device 15. The cleaned transfer belt 3 is then prepared for the next toner image transfer operation.

Here, by simplifying a conveyance path of the recording medium 7 from feeding to discharge as much as possible and increasing the radius of curvature of the conveyance path, paper jams during conveyance are prevented, enabling an improvement in reliability. Furthermore, an elimination processing operation performed when a paper jam does occur can be executed easily. This constitution is also suitable for a color image forming apparatus employing multiple types of recording media, in which thick paper and so on are used.

Further, in the color image forming apparatus of this embodiment, the recording medium conveyance path is substantially arc-shaped, and the transfer belt 3, image creating units 6, and exposure device 5 are disposed on the inner side of the recording medium conveyance path. Thus, the interior space of the apparatus frame body is used effectively, enabling a reduction in size, the conveyance path is constituted simply, and the recording medium 7 is discharged with the image surface facing downward. With this constitution, the conveyance path can be simplified, and substantially all of the constitutional units can be disposed on the inside of the conveyance path. Therefore, the conveyance path is disposed close to the apparatus frame body and can be opened easily, thereby facilitating an elimination processing operation performed when a paper jam occurs. Further, since the recording medium 7 is discharged onto the color image forming apparatus 1 with the image surface facing downward, recording media 7 stacked on the color image forming apparatus 1 are arranged in printing order from the upper side to the lower side when extracted with the image surface side facing upward. Furthermore, since the right side in FIG. 1 constitutes the front surface, an elimination processing operation performed when a paper jam occurs can be executed even more easily.

The upper portion of the color electrophotographic apparatus 1 opens about an upper left shaft la while retaining the exposure device 5, and therefore the expendable image creating unit 6 can be replaced from the front surface by an operator. Hence, the color electrophotographic apparatus 1 is provided with a front access constitution in which all of a series of operations can be performed from the front surface, and as a result, a color electrophotographic apparatus that can be installed anywhere can be realized.

Next, the developing device according to this embodiment will be described.

Figure 2:
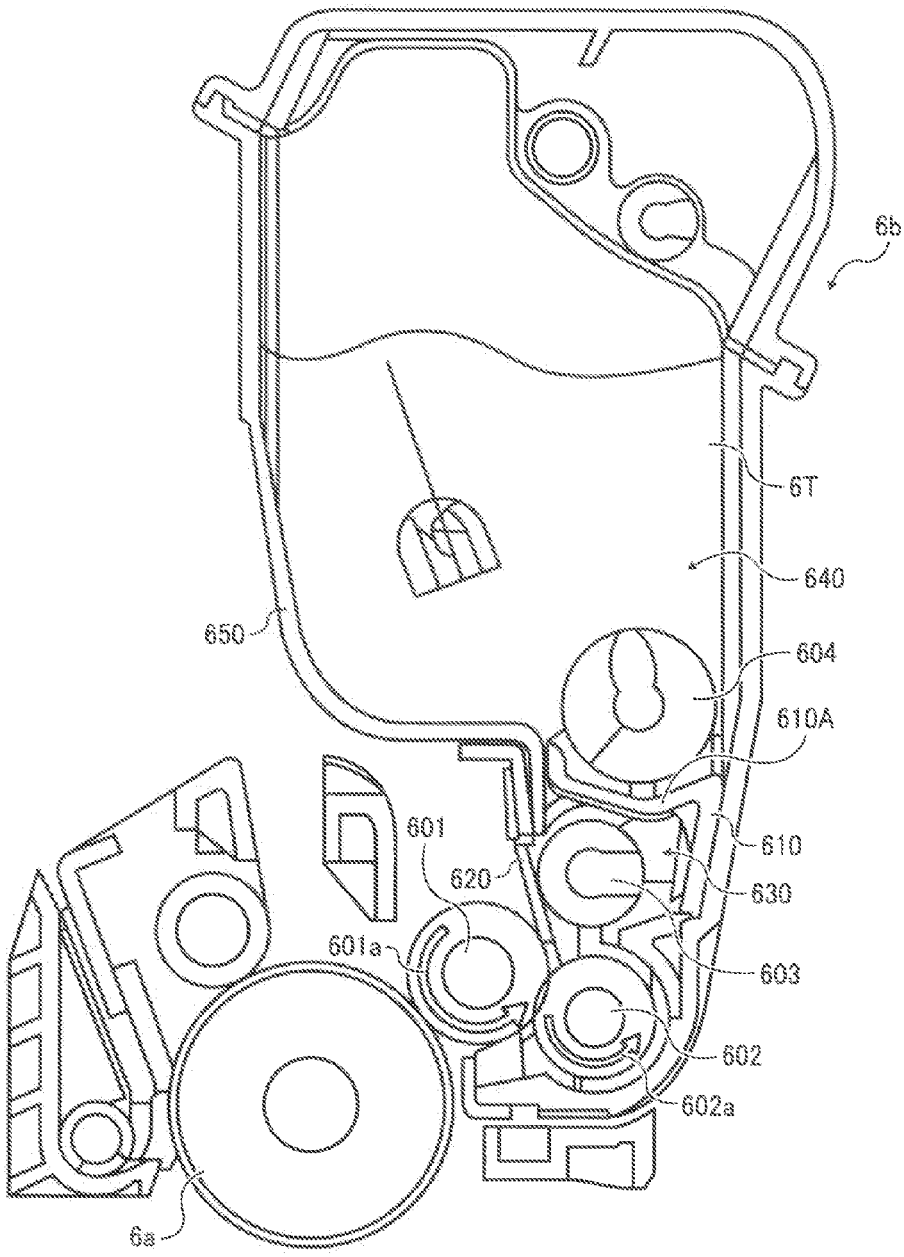
FIG. 2 is a view showing the schematic constitution of an image creating unit of the color image forming apparatus.

FIG. 2 shows the schematic constitution of the image creating unit. The image creating unit 6 is a process cartridge integrally comprising a photosensitive body 6*a*, a charging device, a developing device 6*b*, and a cleaning device. The developing device 6*b* comprises a development roller 601 serving as a developer carrier, a toner replenishment roller 602 serving as a developer supply/collection member disposed in contact with the development roller 601, a developing portion 630 having a development blade 620 that contacts the development roller 601, a toner hopper 640 housing replenishment toner 6T that is supplied to the developing portion 630, and a casing 650 serving as a housing for holding these components. Further, a partitioning member 610A having an opening portion (not shown) is provided between the developing portion 630 and the toner hopper 640. An agitating rotary member 604 is provided in the toner hopper 640 above the partitioning member 610A. An agitating rotary member 603 is also provided in the developing portion 630 below the partitioning member 610A. In the developing portion 630, the development roller 601 rotates in the direction of an arrow 601a while the toner replenishment roller 602 rotates in the direction of an arrow 602*a*. Further, the agitating rotary member 603 and the agitating rotary member 604 move so as to form a vertical direction toner loop flow in order to supply and circulate the toner evenly in an axial direction from above the developing portion 630. The partitioning member 610A serves as a conveyance guide for the toner loop flow. The replenishment toner 6T in the toner hopper 640 is supplied to the developing portion 630 through the opening portion (not shown) in the partitioning member 610A and gradually consumed during color image formation.

The partitioning member 610A partitions the casing 650 into an upper portion serving as the toner hopper 640 and a lower portion serving as the developing portion 630. The partitioning member 610A alleviates situations in which the toner 6T around the developing portion becomes packed in due to the weight of the toner 6T above the agitating rotary member 604, and ensures that the lower developing portion 630 is not affected by packing due to differences in the remaining amount of toner when the toner in the upper portion is full and when the toner in the upper portion is depleted. These are the original functions of the partitioning member 610A.

Figure 3:
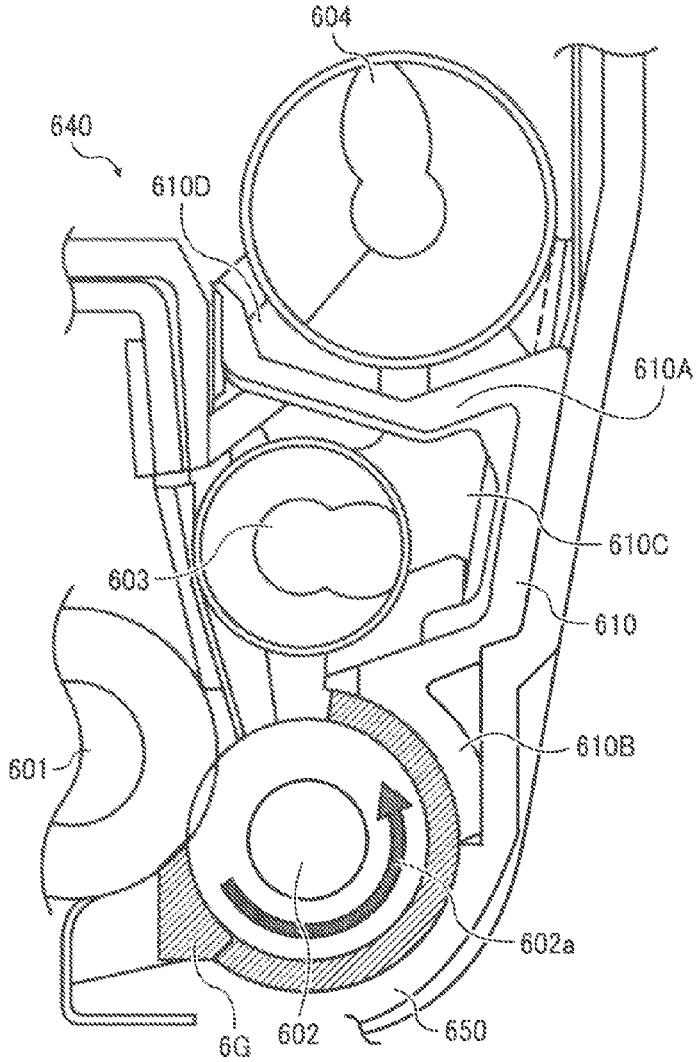
FIG. 3 is a sectional view showing the constitution of a developing portion of the image creating unit.

FIG. 3 shows the schematic constitution of the developing portion. Toner adhered to the surface of the development roller 601 in the contact location between the development roller 601 and the toner replenishment roller 602 is peeled away by the toner replenishment roller 602 and is either conveyed in the direction of the toner replenishment roller rotation arrow 602*a* or falls in a gravitational direction. The toner conveyed on the toner replenishment roller 602 is conveyed upward as is, whereas toner 6G that falls under its own weight accumulates in a bottom portion of the casing 650. Eventually, the gap between the casing 650 and the toner replenishment roller 602 disappears such that the accumulated toner 6G is caught up in a toner flow generated by the rotation of the toner replenishment roller 602, and thus collection of the accumulated toner 6G begins. The toner on the surface of the casing 650 continues to accumulate endlessly, whereas the toner 6GT that is peeled away and falls is gradually collected into the toner flow and circulated upward. Here, a collected toner storage portion forming portion 610B for forming a collected toner storage portion is provided such that the collected toner is efficiently moved upward by the toner flow that is generated by the rotation of the toner replenishment roller 602. The collected toner storage portion forming portion 610B forms a gap or the equivalent between the toner replenishment roller 602 and the casing 650. The collected toner storage portion forming portion 610B is formed integrally with the partitioning member 610A as a pre-incorporation component 610.

Figure 4:
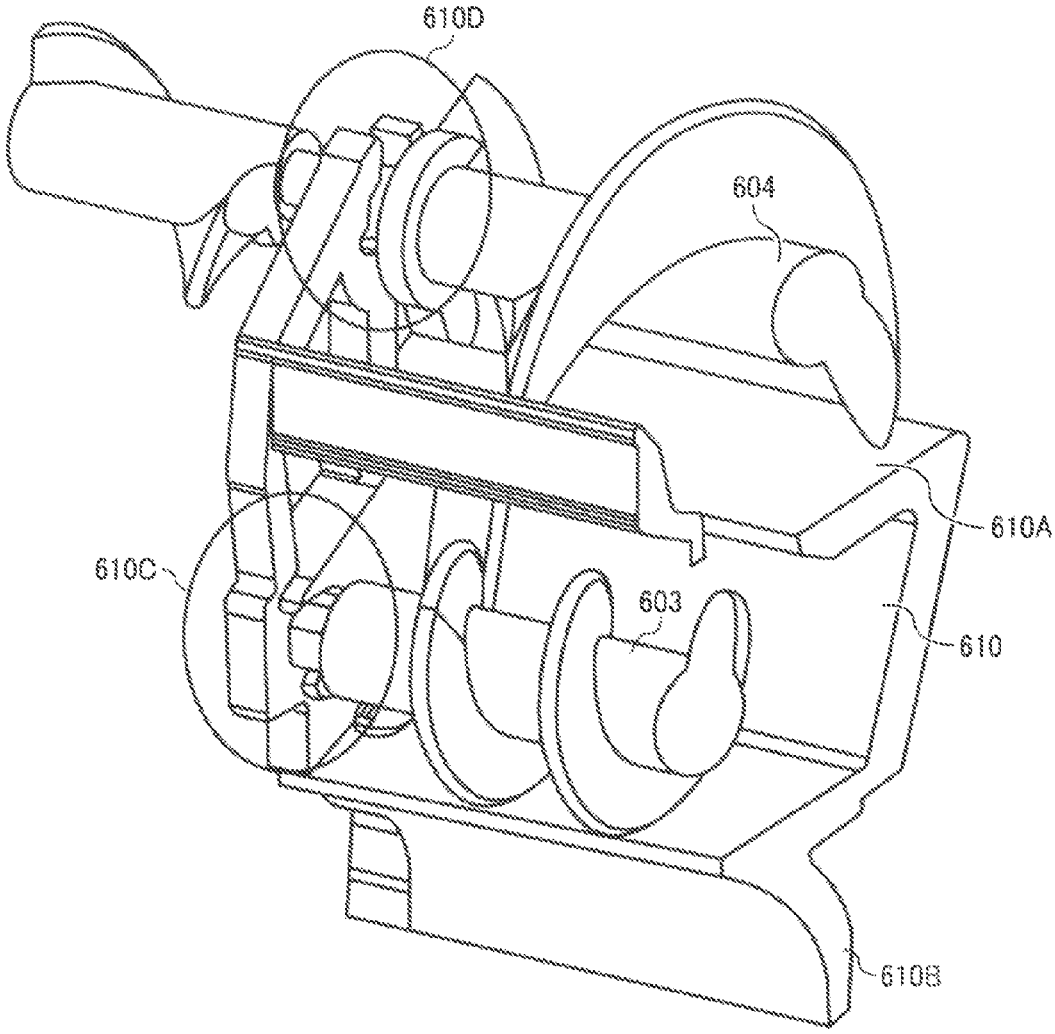
FIG. 4 is a view showing the schematic constitution of an agitating rotary member bearing portion provided in a pre-incorporation component.

FIG. 4 is a view showing the schematic constitution of a component obtained by forming rotary bearing portions 610C, 610D for the agitating rotary member 603 and the agitating rotary member 604 integrally with the pre-incorporation component 610 in which the partitioning member 610A and collected toner storage portion forming portion 610B are formed integrally. The rotational force of the agitating rotary member 603 and the agitating rotary member 604 is transmitted from the outer side of a right end portion, not shown in FIG. 4, of the casing 650 using a gear or the like. The pre-incorporation component 610 receives the agitating rotary member 603 in the bearing portion 610C and the agitating rotary member 604 in the bearing portion 610D. When the pre-incorporation component 610 is formed in this shape, the casing 650, not shown in the drawing, can be formed using a typical injection molding die employed in plastic molding, thereby avoiding a complicated die structure such as an inner slide. When a bearing function is not added to the pre-incorporation component 610, either a bearing function must be added to the casing 650 or a bearing member must be added as a substitute for the pre-incorporation component 610. In the former case, if an inner slide is employed, the die structure becomes complicated, multiple pressing becomes difficult, and the cost of the die increases in proportion with the inner slide structure. It may also be necessary to consider issues related to mass production handling, such as maintenance intervals. Furthermore, the casing 650 is a precision component in which components such as the development roller 601, toner replenishment roller 602 and development blade 620 must be disposed with a high degree of precision, but when the die structure becomes complicated, the heat balance deteriorates, leading to deterioration in the component precision, and as a result, the image quality is adversely affected. These factors can be avoided by avoiding an inner slide and using a simpler outer slide, but in this case a new member for sealing the toner—at least two components here—must be added, which is not preferable if a reasonably-priced product is to be provided.

As described above, by integrating the functions of the partitioning member 610A, the collected toner storage portion forming portion 610B, and the bearing portions 610C, 610D in the form of the pre-incorporation component 610, these components can be held without increasing the complexity of the die structure for molding the casing 650. Since the complexity of the die structure for molding the casing 650 is not increased, the precision with which the casing 650 holds the components can be maintained and the number of incorporated components can be reduced, thereby suppressing cost increases. Note that the holding precision of the partitioning member 610A, the collected toner storage portion forming portion 610B, and the bearing portions 610C, 610D is not as strict as that of the development roller 601 and so on, and sufficient holding precision is obtained by forming these components integrally as the pre-incorporation component 610 and then incorporating the pre-incorporation component 610 in the casing 650. Particularly favorable effects can be expected when the pre-incorporation component 610 is applied to a vertical developing device, in which the toner 6T easily becomes packed into the developing portion.

Figure 5:
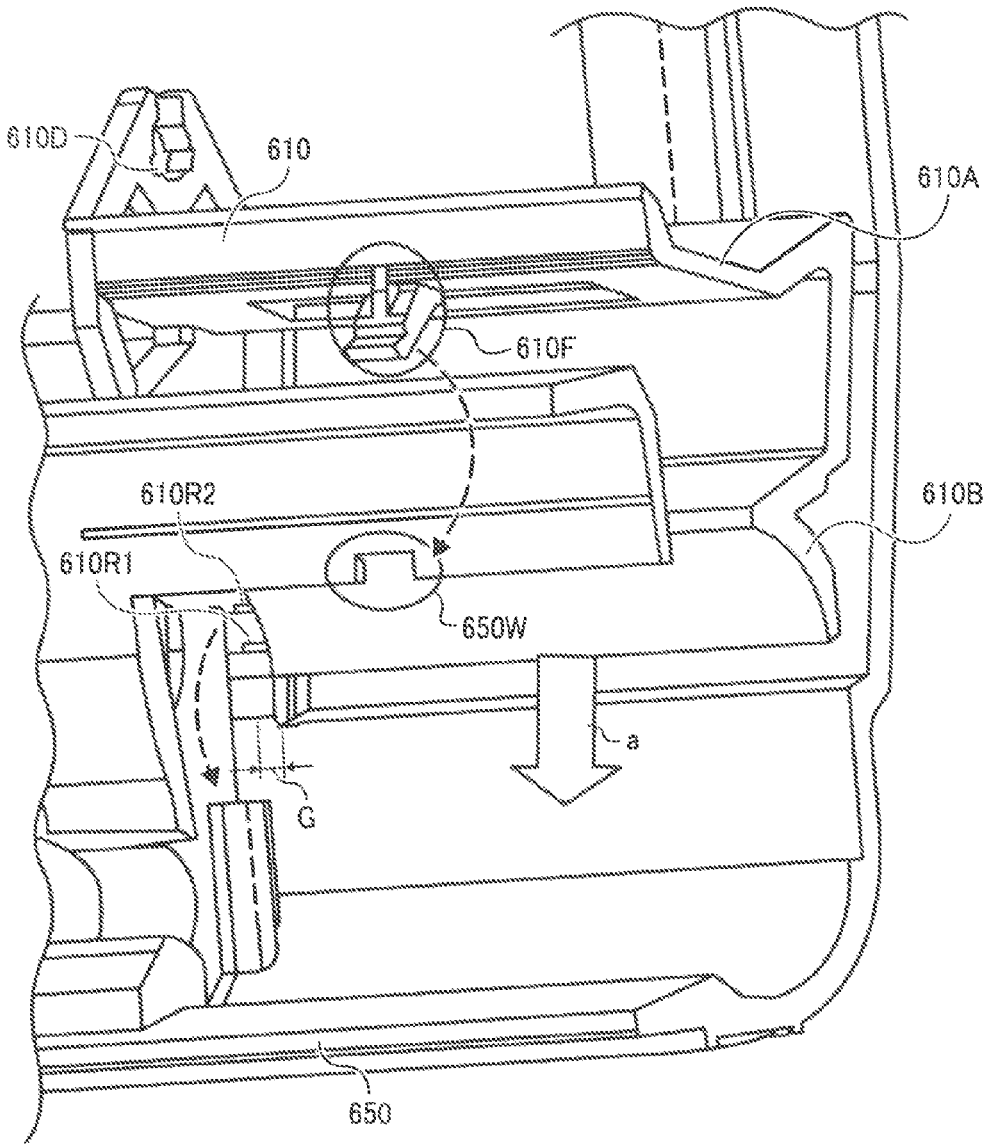
FIG. 5 is a view illustrating a method of fixing the pre-incorporation component to a casing.

FIG. 5 is an illustrative view showing a method for fixing the pre-incorporation component 610 to the casing 650. FIG. 5 shows a method of fitting together and fixing the casing 650 near the outboard side and the pre-incorporation component 610. One or more pawl shapes 610F, such as that shown in the drawing, is formed on each of the left and right sides of the pre-incorporation component 610, and a single pawl shape 610F is preferably provided in the center for a total of three or more pawl shapes 610F. Recessed shapes 650W such as those shown in the drawing are formed in the casing 650 in positions corresponding to the pawl shapes 610F on the pre-incorporation component 610. The pre-incorporation component 610 is inserted in a direction indicated by an arrow a in FIG. 5 such that the pawl shapes 610F abut against the wall of the casing 650. The pawl shape 610F is formed from a flexible molding material, for example a non-filler polymer such as polystyrene (HIPS) or ABS. The casing 650 requires precision and rigidity, and is therefore formed from a material containing a filler, for example glass or mica. The pawl shape 610F bends and is snap-fitted into the recessed shape 650W when inserted into the pre-incorporation component 610 up to a disposal position. Thus the pawl shape 610F exhibits a function for preventing upward falling.

The pre-incorporation component 610 is also provided with a rib 610R1 and a rib 610R2 formed at a dimensional relationship allowing press fitting into a groove G in the casing 650. More specifically, the rib 610R1 has a press-fitting margin relative to the groove G in the casing of no less than 0.05 under maximum tolerance conditions and no more than 0.35 under minimum tolerance conditions, while the rib 610R2 has a press-fitting margin of no less than 0.15 under maximum tolerance conditions and no more than 0.45 under minimum tolerance conditions. The reason for providing the rib 610R1 and the rib 610R2 with different press-fitting margins is that the casing 650 is provided with a draft angle to facilitate die molding, and therefore the rib 610R2 is wider than the rib 610R1. Further, the rib 610R1 is inserted into the groove G in the casing 650 in the direction of the insertion arrow a first and therefore acts to widen the groove G, albeit slightly, leading to an increase in the groove width.

By means of the pawl shapes 610F and the ribs 610R1 and 610R2, the pre-incorporation component 610 can be fixed to the casing 650 securely without the need for welding, adhesion, or tightening with screws.

According to the embodiment described above, the pre-incorporation component 610, which is formed by integrating the bearing portions 610C, 610D of the agitating rotary members 603, 604 and/or the collected toner storage portion forming portion 610B with the partitioning member 610A provided between the developing portion 630 and the toner hopper 640 and having an opening portion, is incorporated into the casing 650, and as a result, the pre-incorporation component 610 can be held without increasing the complexity of the die structure for molding the casing 650. Since the die structure is not complicated, the holding precision with which the casing 650 holds the pre-incorporation component 610 can be maintained, and since the number of incorporated components is reduced, cost increases can be suppressed.

Further, a great effect is obtained by applying the present invention to a vertical developing device in which the developer accommodating portion is disposed above the developing portion such that toner accumulates easily in a gravitational direction.

Further, the pre-incorporation component 610 can be realized easily using a moldable plastic material.

Further, the pre-incorporation component 610 is formed from a molding material having less rigidity than the material of the casing 650. The casing 650 requires precision and rigidity, and is therefore formed from a highly synthetic material. The partitioning member is formed from a flexible molding material, and can therefore be fitted easily.

Further, the pre-incorporation component 610 can be fixed to the casing 650 by means of fitting alone, and therefore means for performing adhesion, welding and so on are not required, enabling a reduction in cost.

Further, the shapes for fixing the pre-incorporation component 610 to the casing 650 are formed in left, right and central locations, and therefore holding precision can be maintained favorably and with stability.

As described above, in the present invention, a pre-incorporation component formed by integrating a collected developer storage portion forming portion and/or a bearing portion of an agitating member with a partitioning member is incorporated into a casing, and as a result, the pre-incorporation component can be held without increasing the complexity of the die structure for molding the casing. Since the die structure for molding the casing is not complicated, the holding precision with which the casing holds the pre-incorporation component can be maintained, and since the number of incorporated components is reduced, cost increases can be suppressed. Note that the partitioning member, the collected developer storage portion forming portion, and the bearing portions of the developing portion developer agitating member and the accommodating portion developer agitating member require less holding precision than the developer carrier and so on, and by forming these members integrally as the pre-incorporation component and incorporating them into the casing, sufficient holding precision is obtained.

Various modifications will become possible for those skilled in the art after receiving the teachings of the present disclosure without departing from the scope thereof.

What is claimed is:

1. A developing device comprising:

a developer carrier for carrying a developer and conveying said developer to an opposing portion opposing a latent image carrier;

a developing portion having a developer supply/collection member for supplying said developer while rotating in contact with said developer carrier and collecting said developer from said developer carrier;

a developer accommodating portion provided above said developing portion and accommodating developer to be supplied to said developing portion;

a partitioning member provided between said developing portion and said developer accommodating portion and having an opening portion;

an accommodating portion developer agitating member disposed above said partitioning member for agitating said developer in said developer accommodating portion;

a developing portion developer agitating member disposed below said partitioning member for agitating said developer in said developing portion;

a collected developer storage portion forming portion for forming a storage space for said developer collected from said developer carrier by said developer supply/collection member within a fixed distance of said developer supply/collection member such that said collected developer moves to the vicinity of said developing portion developer agitating member in accordance with a developer flow generated by the rotation of said developer supply/collection member; and a casing for accommodating and holding all of the above, wherein a pre-incorporation component, separately formed from the casing, formed by integrating said partitioning member, a bearing portion for supporting a side of said developing portion developer agitating member or said accommodating portion developer agitating member that does not receive a drive force, and said collected developer storage portion forming portion is incorporated into said casing.

2. The developing device as claimed in claim 1, wherein said pre-incorporation component is formed from a resin material.

3. The developing device as claimed in claim 1, wherein said pre-incorporation component is formed from a molding material having less rigidity than a molding material of said casing.

4. The developing device as claimed in claim 1, wherein said pre-incorporation component and said casing are fixed by fitting.

5. The developing device as claimed in claim 4, wherein a plurality of fitting members is provided for fitting said pre-incorporation component to said casing.

6. A developing device comprising:

a developer carrier for carrying a developer and conveying said developer to an opposing portion opposing a latent image carrier;

a developing portion having a developer supply/collection member for supplying said developer while rotating in contact with said developer carrier and collecting said developer from said developer carrier;

a developer accommodating portion provided above said developing portion and accommodating developer to be supplied to said developing portion;

a partitioning member provided between said developing portion and said developer accommodating portion and having an opening portion;

an accommodating portion developer agitating member disposed above said partitioning member for agitating said developer in said developer accommodating portion;

a developing portion developer agitating member disposed below said partitioning member for agitating said developer in said developing portion;

a collected developer storage portion forming portion for forming a storage space for said developer collected from said developer carrier by said developer supply/collection member within a fixed distance of said developer supply/collection member such that said collected developer moves to the vicinity of said developing portion developer agitating member in accordance with a developer flow generated by the rotation of said developer supply/collection member; and a casing for accommodating and holding all of the above, wherein a pre-incorporation component, separately formed from the casing, formed by integrating said partitioning member and said collected developer storage portion forming portion is incorporated into said casing.

7. The developing device as claimed in claim 6, wherein said pre-incorporation component is formed from a resin material.

8. The developing device as claimed in claim 6, wherein said pre-incorporation component is formed from a molding material having less rigidity than a molding material of said casing.

9. The developing device as claimed in claim 6, wherein said pre-incorporation component and said casing are fixed by fitting.

10. The developing device as claimed in claim 9, wherein a plurality of fitting members is provided for fitting said pre-incorporation component to said casing.

11. A developing device comprising:

a developer carrier for carrying a developer and conveying said developer to an opposing portion opposing a latent image carrier;

a developing portion having a developer supply/collection member for supplying said developer while rotating in contact with said developer carrier and collecting said developer from said developer carrier;

a developer accommodating portion provided above said developing portion and accommodating developer to be supplied to said developing portion;

a partitioning member provided between said developing portion and said developer accommodating portion and having an opening portion;

an accommodating portion developer agitating member disposed above said partitioning member for agitating said developer in said developer accommodating portion;

a developing portion developer agitating member disposed below said partitioning member for agitating said developer in said developing portion; and a casing for accommodating and holding all of the above, wherein a pre-incorporation component, separately formed from the casing, formed by integrating said partitioning member and a bearing portion for supporting a side of said developing portion developer agitating member or said accommodating portion developer agitating member that does not receive a drive force is incorporated into said casing.

12. The developing device as claimed in claim 11, wherein said pre-incorporation component is formed from a resin material.

13. The developing device as claimed in claim 11, wherein said pre-incorporation component is formed from a molding material having less rigidity than a molding material of said casing.

14. The developing device as claimed in claim 11, wherein said pre-incorporation component and said casing are fixed by fitting.

15. The developing device as claimed in claim 14, wherein a plurality of fitting members is provided for fitting said pre-incorporation component to said casing.

* * * * *